US007594371B2

(12) United States Patent
Suolahti

(10) Patent No.: US 7,594,371 B2
(45) Date of Patent: Sep. 29, 2009

(54) METHOD AND DEVICE FOR FORMING A TOP FILM SHEET FROM A FILM WEB

(75) Inventor: Yrjö Suolahti, Mynamaki (FI)

(73) Assignee: Oy M. Haloila AB, Masku (FI)

( * ) Notice: Subject to any disclaimer, the term of this patent is extended or adjusted under 35 U.S.C. 154(b) by 0 days.

(21) Appl. No.: 11/883,924

(22) PCT Filed: Feb. 9, 2006

(86) PCT No.: PCT/IB2006/000253

§ 371 (c)(1),
(2), (4) Date: Aug. 8, 2007

(87) PCT Pub. No.: WO2006/085197

PCT Pub. Date: Aug. 17, 2006

(65) Prior Publication Data

US 2008/0202071 A1 Aug. 28, 2008

(30) Foreign Application Priority Data

Feb. 10, 2005 (FI) ..... 20050153

(51) Int. Cl.
*B65B 41/14* (2006.01)
*B65B 11/02* (2006.01)

(52) U.S. Cl. ..... 53/389.3; 53/203; 53/218

(58) Field of Classification Search ..... 53/461, 53/463, 465, 176, 203, 210, 218, 228, 556, 53/389.1, 389.2, 389.3
See application file for complete search history.

(56) References Cited

U.S. PATENT DOCUMENTS

| | | | | | |
|---|---|---|---|---|---|
| 3,777,452 | A * | 12/1973 | Koenders | 53/218 |
| 3,967,433 | A * | 7/1976 | Bonfiglioli | 53/228 |
| 4,513,558 | A * | 4/1985 | Treiber | 53/389.2 |
| 4,583,348 | A * | 4/1986 | Treiber et al. | 53/389.3 |
| 4,936,080 | A * | 6/1990 | Haloila | 53/218 |
| 5,595,042 | A * | 1/1997 | Cappi et al. | 53/556 |
| 5,603,198 | A * | 2/1997 | Rimondi et al. | 53/556 |
| 6,170,236 | B1 * | 1/2001 | Whitby et al. | 53/556 |
| 6,189,302 | B1 | 2/2001 | Kudo et al. | |
| 6,192,662 | B1 * | 2/2001 | Rimondi et al. | 53/556 |
| 6,247,292 | B1 | 6/2001 | Whitby et al. | |
| 6,945,018 | B2 * | 9/2005 | Suolahti | 53/210 |
| 2004/0226271 | A1 | 11/2004 | Suolahti | |

* cited by examiner

*Primary Examiner*—Louis K Huynh
(74) *Attorney, Agent, or Firm*—Law Offices of Steven W. Weinrieb

(57) ABSTRACT

Apparatus for forming a top film sheet from a film web wound upon a roll of film and for setting it onto an object to be packaged. A free end portion of the film depends downwardly from a pair of holding jaws, and a pair of pulling jaws is movable between an EXTENDED position at which the pair of pulling jaws will be disposed beneath the pair of holding jaws so as to grasp the free end portion depending downwardly from the pair of holding jaws, and a RETRACTED position at which the pair of pulling jaws will cause a portion of the film to be withdrawn from the roll of film so as to form the top film sheet after the portion of the film, withdrawn from the roll of film, is severed by a cutting blade.

11 Claims, 12 Drawing Sheets

METHOD AND DEVICE FOR FORMING A TOP FILM SHEET FROM A FILM WEB

FIELD OF THE INVENTION

Figure 1:
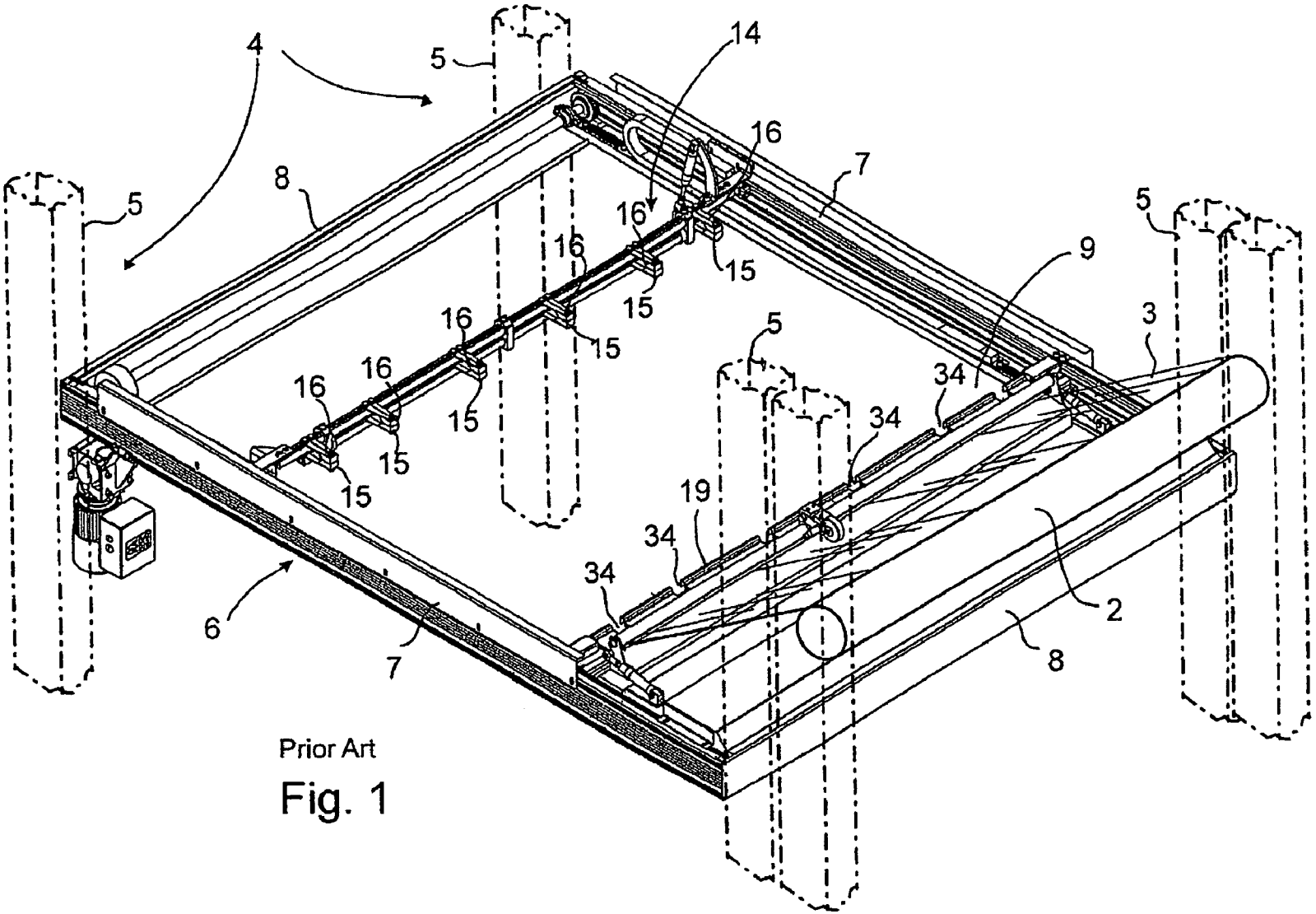
Prior Art Fig. 1

The present invention relates to an apparatus for forming a top film sheet from a film web wound upon a roll of film and for setting it onto an object to be packaged. A free end portion of the film depends downwardly from a pair of holding jaws, and a pair of pulling jaws is movable between an EXTENDED position at which the pair of pulling jaws will be disposed beneath the pair of holding jaws so as to grasp the free end portion depending downwardly from the pair of holding jaws, and a RETRACTED position at which the pair of pulling jaws will cause a portion of the film to be withdrawn from the roll of film so as to form the top film sheet after the portion of the film, withdrawn from the roll of film, is severed by a cutting blade.

BACKGROUND OF THE INVENTION

Referring to FIGS. 1 and 1A-1E, a prior-art device for forming a top film sheet 1 from a film web 3 wound on a roll 2 and setting it onto an object to be packaged (not shown) is known from specification EP 0 336 517 B1 and from a prior-art wrapping machine marketed under the trademark "Octopus". This prior-art device for setting a sheet comprises a machine frame 4 supported on a fixed base. The machine frame 4 comprises vertical upright columns 5, which are outlined in FIG. 1 in dotted broken lines.

The device further comprises a frame 6, which comprises two parallel guide beams 7 disposed at a distance from each other and secured by their ends to each other with transverse bars 8 to form a rectangular horizontal frame structure. The frame 6, guided by the upright columns 5, is arranged to be movable upwards and downwards in the vertical direction.

Such a device is normally used in conjunction with a prior-art wrapping machine, where a top film sheet is first set onto an object to be wrapped, usually a loaded pallet, whereupon the object is wrapped around with film web in a spiralling fashion. For this purpose, a wrapping frame may be attached to the aforesaid frame 6 to guide a film dispenser delivering the film (as in FIG. 2). Alternatively, the film dispenser may be connected to a crank that turns about a vertical axis, as in specification EP 0 336 517 B1.

The device further comprises a holding device fixedly mounted on the guide beams 7 and extending transversely between them. The holding device 9 comprises a pair of holding jaws 10, 11, which are movable relative to each other between a closed position I and an opened position II. In the closed position I (see FIGS. 1A, 1B, 1D and 1E), the holding jaws 10 and 11 are pressed together from opposite sides of the film web to grip the film web between the holding jaws 10 and 11. In the opened position II (see FIG. 1C), the holding jaws 10 and 11 have a first gap 12 between them to allow the film web 3 to move between the holding jaws.

The device further comprises a cutting device 13, which is disposed in the vicinity of the holding device 9 for severing the film web 3.

The device additionally comprises a pulling device 14, which extends transversely between the guide beams 7 and is mounted on the guide beams so as to be movable between a first position A (see FIG. 1B) located near the holding device 9 and a second position B located at a distance from the holding device 9 (see FIGS. 1A, 1C-1E).

Figure 1A:
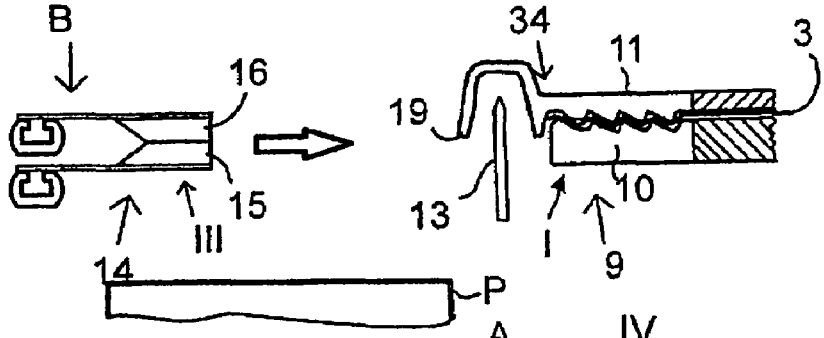
Prior Art Fig. 1A

As shown in FIG. 1A, the pulling device 14 comprises a pair of pulling jaws 15, 16, which are movable relative to each other between a closed position III and an opened position IV. In the closed position III (see FIGS. 1A, 1C and 1D), the pulling jaws 15, 16 are pressed together from opposite sides of the film web to grip the film web between the pulling jaws. In the opened position IV (see FIGS. 1B and 1F), the pulling jaws 15, 16 have a second gap 17 between them to release the film web 3 from the grip of the pulling jaws.

As can be seen from FIG. 1, the pulling jaws 15 and 16 are claws which have a point-like grip on the film. 'Point-like grip' here means a grip over a very small surface area. The claws 15, 16 hold the film web with a point-like grip. The device has several pairs of claws 15, 16 at a distance from each other over the width of the film web. Several pairs of claws 15, 16 are provided to enable the pulling device to pull webs of different widths so that the claws always engage the film by its edges and additionally between the edges. The thinner the film used, the more pairs of claws 15, 16 are needed in the pulling device to distribute the pulling force over the film. For the claws 15, 16 to be able to grip the end of the film web, the support 19 included in the holding device 9 and serving as a counter-element for the cutting blade must be provided with notches 34 corresponding to the claws to receive the claws when the pulling device 14 fetches the end of the film web from the holding device 9.

Referring to FIGS. 1A-1E, the device in FIG. 1 is operated according to the prior-art method in the following steps.

FIG. 1A visualizes that, at the beginning of the cycle, the holding device 9 engages the film web 3 with a first grip near its free end on a first side of the object to be packaged.

Figure 1B:
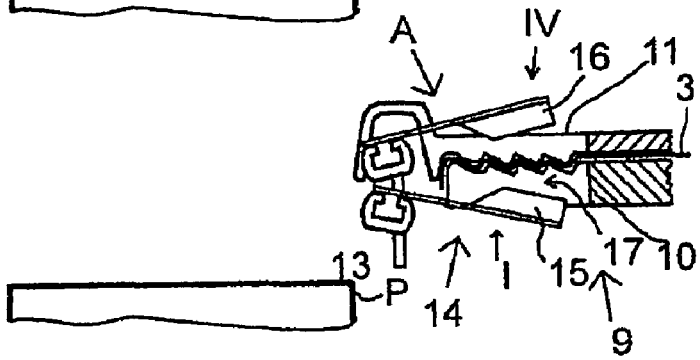
Prior Art Fig. 1B

As shown in FIG. 1B, the pulling device 14 engages the free end of the film web with a second grip.

Figure 1C:
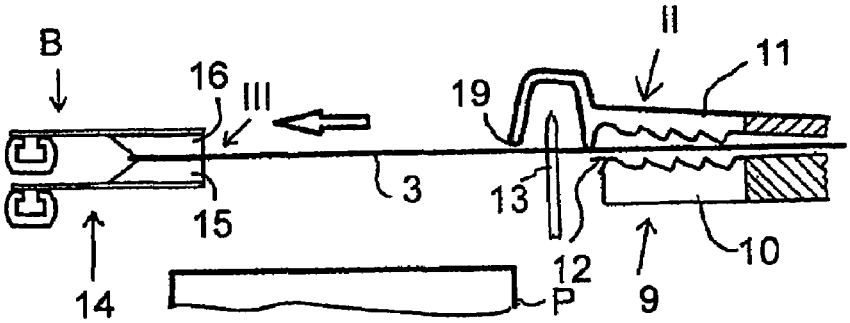
Prior Art Fig. 1C

As shown in FIG. 1C, the first grip of the holding device 9 is released and, maintaining the second grip of the pulling device 14 on the end of the film web, the free end of the film web is pulled horizontally to a distance from the point of the first grip onto the object to be packaged, to its second side, said distance corresponding to the length of the top film sheet to be formed.

Figure 1D:
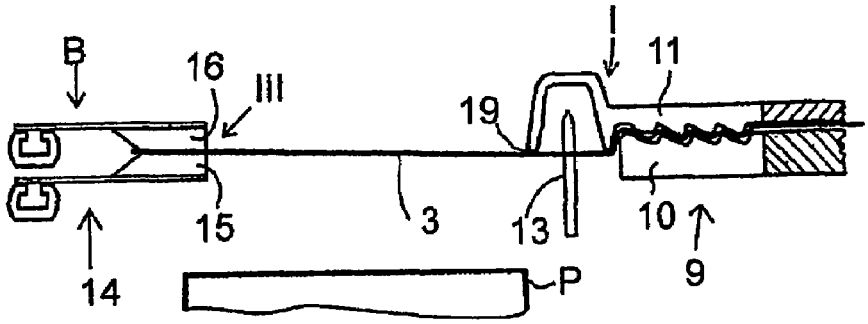
Prior Art Fig. 1D

As shown in FIG. 1D, the film web is held fast with a third grip by the holding device 9 on the first side of the object to be packaged.

Figure 1E:
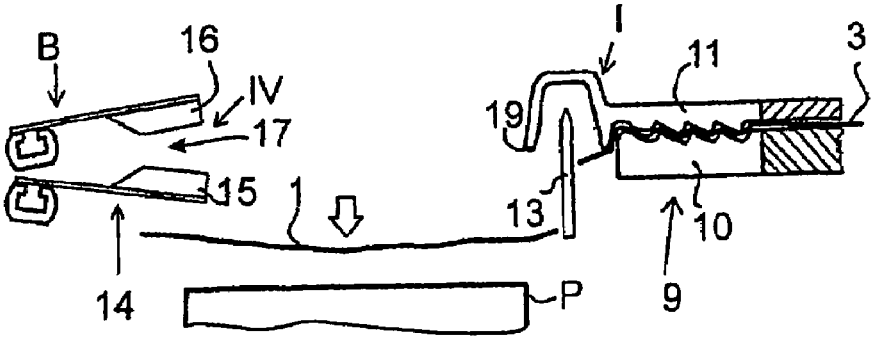
Prior Art Fig. 1E

As shown in FIG. 1E, the film web is severed by means of a cutting device 13 along a cutting line near the third grip to form a top film sheet 1 and the second grip on the end of the film web is released, thus allowing the top film sheet 1 to fall freely onto the object to be packaged. The third grip taken by the holding device 9 constitutes the first grip on the end of the film web for a new sheet forming cycle. To form the next sheet, the steps of FIGS. 1A-1E are performed again.

A problem with the prior-art device and method is that all the pairs of claws 15, 16 must be made to grip the film web with equal force and that a sufficient pressing power must be available to allow the film web to be pulled from the roll 2, which does not necessarily always turn very easily and therefore pulling the film requires the use of force. In the case of thin film, a large number of claw pairs 15, 16 must be available and the claws and notches 34 have to be fitted to the width of the film to be used. In accordance with the positions of the claw pairs, the counter-support 19 has to be provided with many different arrays of notches 34 because, depending on the user's needs, it may sometimes be necessary to use a narrow film and sometimes a wide film. These have to be fitted in such a way that the device will work properly. The outermost notch and claw pair have to be very close to the side edge of the film web. Such individual fitting work is time-consuming and difficult. Due to the notches 34 in the cutting counter-support 19, problems also appear when the film is being severed, because in the area of the notch 34 the film web may not be severed completely because in the region of the notch the film can withdraw before the cutting blade. In the prior-art device, problems occur especially when the film is very thin, e.g. of the order of 15 μm.

OBJECT OF THE INVENTION

The object of the present invention is to overcome the above-mentioned drawbacks.

A specific object of the invention is to disclose a method and a device that will make it possible to use in the device a very thin film, even of a thickness of the order of 15 μm, to form a top film sheet. A further object is to disclose a device in which the width of the film web to be used is not limited but may be a freely selectable width narrower than a predetermined maximum width in the device. A further object is to disclose a device and a method that will always guarantee complete severing of the film web. An additional object is to disclose a device that is simpler, more reliable and cheaper than earlier devices. Yet another object is to disclose a device the manufacture of which requires no customer-specific fitting and is therefore cheaper than before.

BRIEF DESCRIPTION OF THE INVENTION

The present invention is directed toward an apparatus for forming a top film sheet from a film web wound upon a roll of film and for setting it onto an object to be packaged. A free end portion of the film depends downwardly from a pair of holding jaws, and a pair of pulling jaws is movable between an EXTENDED position at which the pair of pulling jaws will be disposed beneath the pair of holding jaws so as to grasp the free end portion depending downwardly from the pair of holding jaws, and a RETRACTED position at which the pair of pulling jaws will cause a portion of the film to be withdrawn from the roll of film so as to form the top film sheet after the portion of the film, withdrawn from the roll of film, is severed by a cutting blade.

In the method according to the invention, the end of the film web is gripped by a second grip over the entire width of the film web. The film web is gripped by a first grip and a third grip at a point located at a distance from the cutting line such that near the free end there remains a length of film web hanging freely downwards so that this length of film web can be gripped by the second grip.

In an embodiment of the method, the film web is supported in the area near the cutting line from the top side of the film web over the entire width of the film web on the other side of the cutting line in relation to the third grip.

In an embodiment of the method, the second grip is formed as a substantially continuous unbroken grip extending over the entire width of the film web.

In an embodiment of the method, the film web is severed by slitting.

In an embodiment of the method, the film web is gripped by the first and third grips over the entire width of the film web.

In an embodiment of the method, the first and the third grips are formed as substantially continuous unbroken grips extending over the entire width of the film web. A substantially continuous unbroken grip may be e.g. a line-like grip or a succession of point-like gripping points very close to each other, which in practice correspond to a line-like grip.

In an embodiment of the method, the first, the second and the third grips are formed by pressing the film web between two jaws.

According to the invention, in the device the motion of the pulling jaws between the closed position and the open position takes place in a substantially horizontal direction. The pulling jaws have been arranged to grip the end of the film web over the entire width of the film web. The gripping line of the holding jaws is at a distance from the cutting line of the cutting device, so that near the free end of the film web there remains a length of film web hanging freely downwards that can be gripped by the pulling jaws.

In an embodiment of the device, the device comprises a support arranged near the cutting device to support the film web from the top side over the entire width of the film web along a supporting line located on the other side relative to the cutting line of the cutting device than the gripping line of the holding jaws.

In an embodiment of the device, the cutting device comprises a slitting blade controlled to be movable in the transverse direction of the film web to slit the film web so as to sever it, and a first power means for moving the slitting blade.

In an embodiment of the device, the pulling device comprises a first frame, which extends between the guide beams and is controlled to be movable on the guide beams so that it is guided and supported by these. Further, the pulling device comprises a first pulling jaw, which is secured to the first frame. Further, the pulling device comprises a second frame, which is movable in relation to the first frame. Further, the pulling device comprises substantially horizontal guide bars for controlling the mutual motion of the first frame and the second frame. Further, the pulling device comprises a second pulling jaw, which is secured to the second frame. In addition, the pulling device comprises a second power means for moving the second frame with respect to the first frame to move the first and the second pulling jaws between a closed position and an opened position.

In an embodiment of the device, the device has a first elastic element connected to at least one of the pulling jaws to achieve an elastic grip when the pulling jaws are pressed against each other.

In an embodiment of the device, a second elastic element is connected to at least one of the holding jaws to achieve an elastic grip when the holding jaws are pressed against each other.

In an embodiment of the device, the pulling jaw and/or the holding jaw is an elongated profiled bar.

In an embodiment of the device, the profiled bar forming the pulling jaw and/or the holding jaw has a longitudinal mounting slot. The first elastic element and/or the second elastic element is an elongated profiled strip formed from elastic material and provided with fastening elements for fastening to the mounting slot.

In an embodiment of the device, the second power means is a compression cylinder or the like, arranged to act in a point-like manner on the middle part of the first frame and the second frame. The profiled bar forming the second pulling jaw is secured to the second frame in a curved shape such that, when being moved from the opened position to the closed position, both ends of the profiled bar of the second pulling jaw touch the first pulling jaw first and in the closed position the middle part of the profiled bar of the second pulling jaw also touches the first pulling jaw, a constant compression force thus acting between the pulling jaws over the entire width of the film web.

In an embodiment of the device, the holding device comprises a third frame, which extends between the guide beams and is connected to the guide beams. Further, the holding device comprises a first holding jaw, which is secured to the third frame. Further, the holding device comprises a fourth frame, which is pivotally connected to the third frame. Further, the holding device comprises a second holding jaw, which is secured to the fourth frame. In addition, the holding device comprises a third power means for turning the fourth frame in relation to the third frame to move the first and the second holding jaws between the closed position and the opened position.

In an embodiment of the device, the cutting device is secured to the third frame.

In an embodiment of the device, the third frame is pivotally mounted so as to be turnable in relation to the guide beams. The device comprises a fourth power means for tilting the third frame.

LIST OF FIGURES

Figure 2:
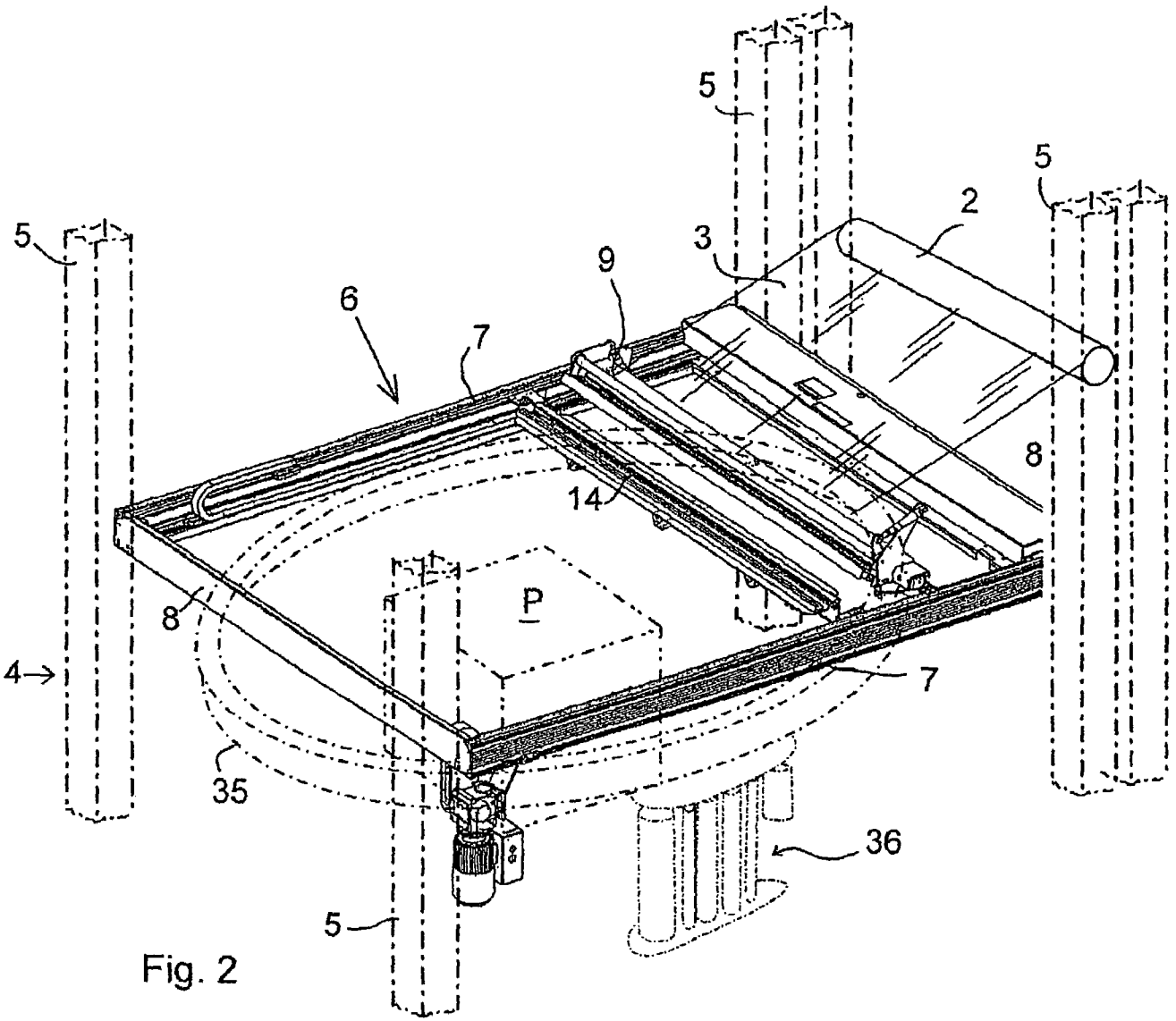
Figure 3:
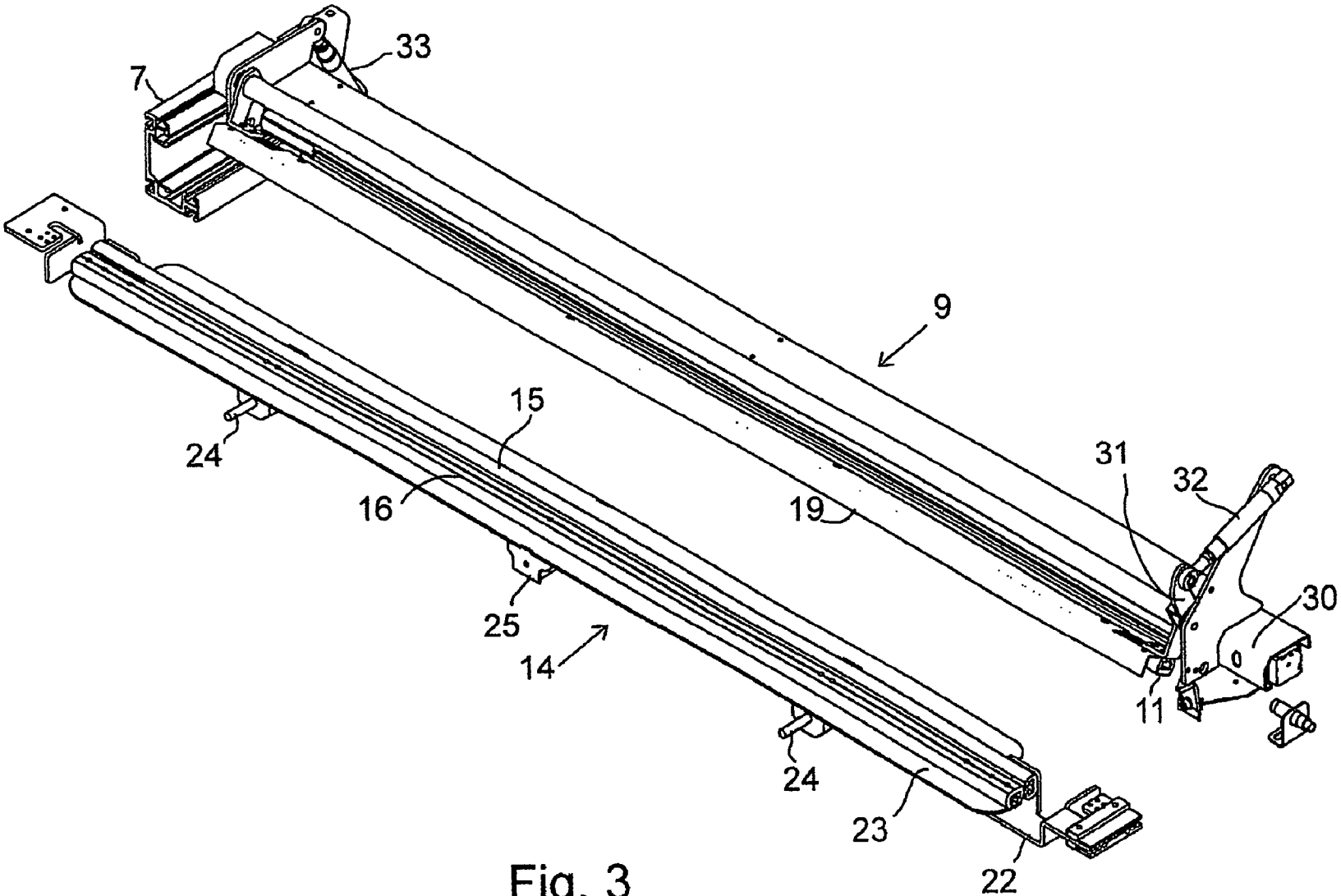

In the following, the invention will be described in detail with reference to embodiment examples and the attached drawing, wherein FIG. 1 presents a diagrammatic axonometric oblique top view of a prior-art apparatus for setting a top film sheet, FIGS. 1A-1E present diagrammatic side views of the holding device, pulling device and cutting device of the prior-art apparatus at different stages of the prior-art method, FIG. 2 presents a diagrammatic axonometric oblique top view of an embodiment of the apparatus of the invention, FIG. 3 presents a diagrammatic axonometric oblique top view of the holding device and pulling device of the apparatus in FIG. 2, separated from the rest of the apparatus, and FIGS. 4-11 present diagrammatic side views of the holding and pulling devices of FIG. 3 at different stages of the method of the invention.

DETAILED DESCRIPTION OF THE INVENTION

FIG. 2 presents a device which can be used to form a top film sheet 1 from a film web 3 wound on a roll 2 and to set it onto an object P to be packaged (presented diagrammatically in dotted broken lines). The object P to be packaged may be e.g. a loaded pallet. The device comprises a machine frame 4 supported on a solid floor base. The machine frame 4 comprises vertical upright columns 5, depicted in dotted broken lines in the figure. The device further comprises a frame 6. The frame 6 comprises two parallel guide beams 7 disposed at a distance from each other and secured by their ends to each other with transverse bars 8 to form a rectangular horizontal frame structure. The frame 6, guided by the upright columns 5, has been arranged to be movable upwards and downwards in the vertical direction using known arrangements not shown. If the device is connected to a conventional wrapping machine, a wrapping frame 35 may be connected to the frame 6 to guide a film dispenser 36 from which a wrapping film web is delivered to wrap the sides of the object to be packaged in a spiralling or collar-like fashion or in some other conventional manner. Alternatively, the film dispenser may be connected in a second conventional manner to a crank revolving about a vertical axis.

The device comprises a holding device 9 fixedly mounted on the guide beams 7 and extending transversely between them. As shown in FIGS. 4-10, the holding device comprises a pair of holding jaws 10,11 which are movable relative to each other between a closed position I (see FIGS. 4 5, and 7) and an opened position II (see FIG. 6). In the closed position I, the holding jaws 10 and 11 are pressed together from opposite sides of the film web to grip the film web between the holding jaws. In the opened position II, the holding jaws 10,11 have a first gap 12 between them to allow the film web to move between the holding jaws 10, 11.

As can best be seen from FIGS. 4-10, the holding device 9 comprises a third frame 30, which extends between the guide beams 7 and is connected to the guide beams 7. A first holding jaw 10 is secured to the third frame 30. A fourth frame 31 is pivotally connected to the third frame 30. A second holding jaw 11 is secured to the fourth frame 31. A third power means 32 is arranged for pivotally moving the fourth frame 31 in relation to the third frame 30 so as to move the first and the second holding jaws 10,11 between the closed position I and the opened position II. The third frame 30 is pivotally mounted so as to be pivoted in relation to the guide beams 7. The device comprises a fourth power means 33 for tilting the third frame 30.

A cutting device 13, secured to the third frame 30, is provided near the holding device 9 for severing the film web 3. The cutting device 13 comprises a slitting blade 20, which is guided to be movable in the transverse direction of the film web 3 from one longitudinal edge of the film web to the other to slit the film web apart. The blade 20 is moved by a first power means 21.

The gripping line of the holding jaws 10, 11 is at a distance from the cutting line of the cutting device 13 so that near the free end of the film web 3 there remains a length 18 of film web hanging freely downwards that can be gripped by the pulling jaws 15, 16 of the pulling device 14 (see FIGS. 4, 5, 8-10).

The holding jaws 10, 11 are elongated profiled bars, which are preferably formed from aluminum profiles of identical cross-section. Connected to holding jaw 10 is a second elastic element 27 to achieve an elastic grip when the holding jaws 10 and 11 are pressed against each other. The profiled bar forming holding jaw 10 is provided with a longitudinal mounting slot 28. The second elastic element 27 is an elongated profiled strip formed from an elastic material, such as rubber or elastic plastic, and provided with fastening elements 29 for fastening to the mounting slot 28.

Figure 4:
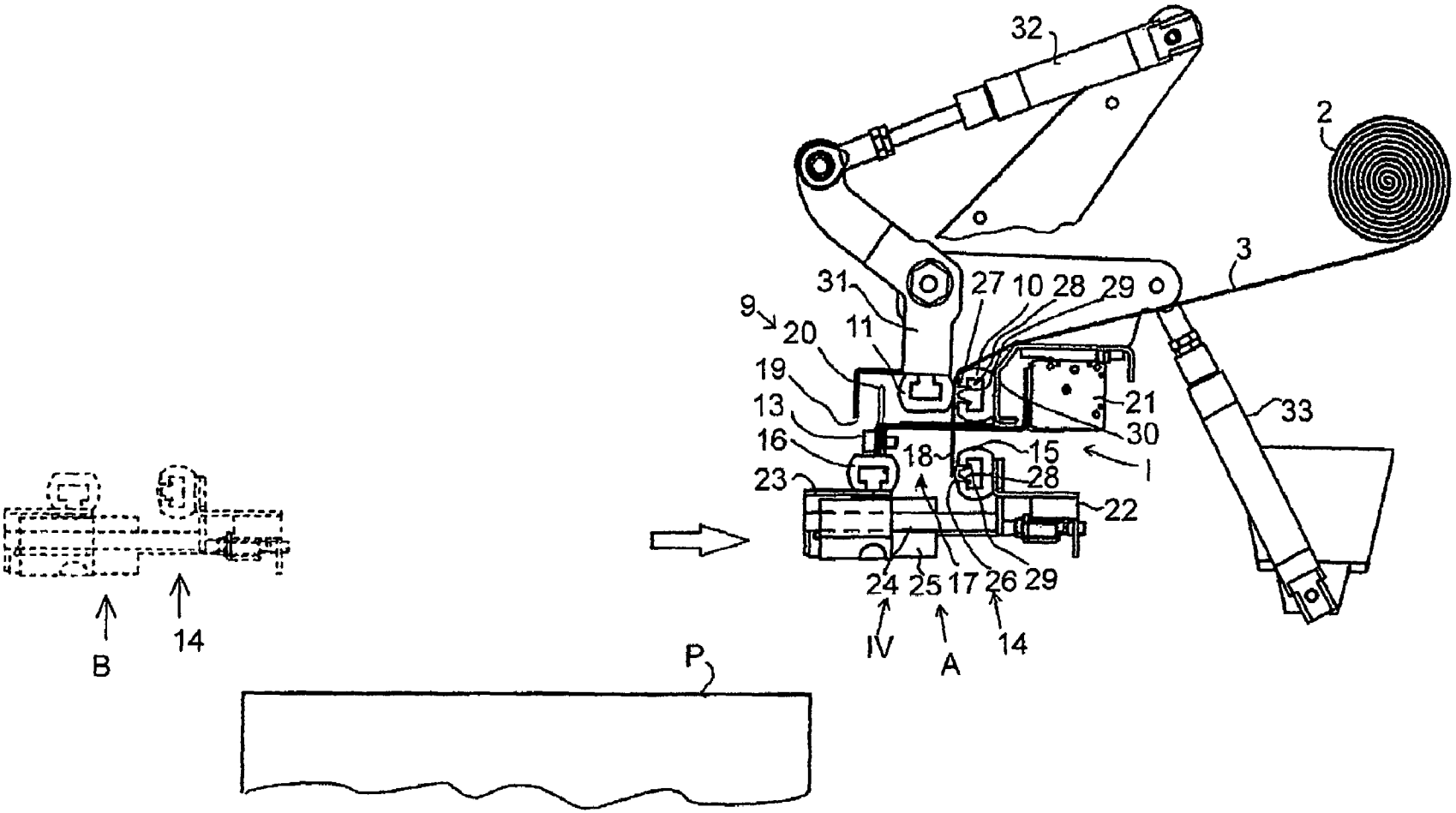

Further referring to FIGS. 3 and 4, the device comprises a pulling device 14, which extends transversely between the guide beams 7 and is mounted on the guide beams 7 so as to be movable between a first position A located near the holding device 9 and a second position B located at a distance from the holding device 9. The pulling device 14 comprises a pair of pulling jaws 15,16 which are movable relative to each other between a closed position III (see FIGS. 5-8,11) and an opened position IV (see FIGS. 4,9,10). In the closed position III, the pulling jaws 15,16 are pressed together from opposite sides of the film web so as to grip the film web between the pulling jaws 15,16. In the opened position IV, the pulling jaws 15,16 have a second gap 17 between them so as to release the film web from the grip of the pulling jaws 15,16. The pulling jaws 15,16 have been arranged so as to grip the end of the film web over the entire width of the film web, and the motion of the pulling jaws 15,16 between the closed position III and the opened position IV takes place horizontally so that the pulling jaws can grip the downwardly hanging part 18 of the film web disposed below the holding jaws 10,11 (see FIGS. 4 and 5).

As shown in FIGS. 3, 4-11, the pulling device 14 comprises a first frame 22, which extends between the guide beams 7 and is controlled to be movable on the guide beams so that it is guided and supported by these. The first pulling jaw 15 is secured to the first frame 22. A second frame 23 is movable in relation to the first frame 22. Two horizontal guide bars 24 are arranged for controlling the mutual motion of the first frame 22 and the second frame 23. The second pulling jaw 16 is secured to the movable second frame 23. A second power means 25 is arranged for moving the second frame 23 with respect to the first frame 22 to move the first and the second pulling jaws 15, 16 between the closed position III and the opened position IV.

The pulling jaws 15,16 are elongated profiled bars which are preferably formed from aluminum profiles of identical cross-section. Connected to pulling jaw 15 is a first elastic element 26 to achieve an elastic grip when the pulling jaws 15,16 are pressed against each other. The profiled bar forming the pulling jaw 15 has a longitudinal mounting slot 28. The first elastic element 26 is an elongated profiled strip formed from an elastic material, such as rubber or elastic plastic, and is provided with fastening elements 29 for fastening to the mounting slot 28.

As can be seen from FIG. 3, the second power means 25 in the pulling device 14 is a power cylinder or the like, arranged to act in a point-like manner on the middle part of the first frame 22 and the second frame 23. The profiled bar forming the second pulling jaw 16 is secured to the second frame 23 in a curved shape in a horizontal plane so that, when being moved from the opened position IV to the closed position III, both ends of the profiled bar of the second pulling jaw 16 touch the first pulling jaw 15 first and in the closed position the middle part of the profiled bar of the second pulling jaw 16 also touches the first pulling jaw 15, a constant compression force thus acting between the pulling jaws 15, 16 over the entire width of the film web.

As the third power means 32 of the holding device 9 acts on the end of the fourth frame 31, the profiled bar forming the second holding jaw 11 in the holding device 9 is secured to the fourth frame 31 in a curved shape such that, when being moved from the opened position II to the closed position I, the middle part of the profiled bar of the first holding jaw 11 touches the first holding jaw 10 first and in the closed position I the ends of the profiled bar of the second holding jaw 11 also touch the first holding jaw 10, a constant compression force thus acting between the holding jaws 10, 11 over the entire width of the film web.

As shown in FIGS. 3 and 4-11, the device further comprises a support 19 secured to the third frame 30 near the cutting device 13 to support the film web from the top side over the entire width of the film web 3 along a supporting line located on the other side relative to the cutting line of the cutting device 13 than the gripping line of the holding jaws 10, 11.

In the following, the operation of the device will be described with reference to FIGS. 4-11.

In FIG. 4, the holding jaws 10 and 11 of the holding device 9 are in the closed position I, pressed together so that the film web 3 is in their grip, which is here referred to as a first grip. At the free end of the film web 3 drawn from the roll 2, a length 18 of film web hangs freely downwards below the holding jaws 10, 11. In FIG. 4, the pulling device 14 is in the opened position IV and moved to the first position A near the holding device 9, in which position its pulling jaws 15 and 16 are below the holding jaws 10, 11. A second gap 17 remains between the pulling jaws 15, 16, and the length 18 of film web hangs down into this gap 17.

Figure 5:
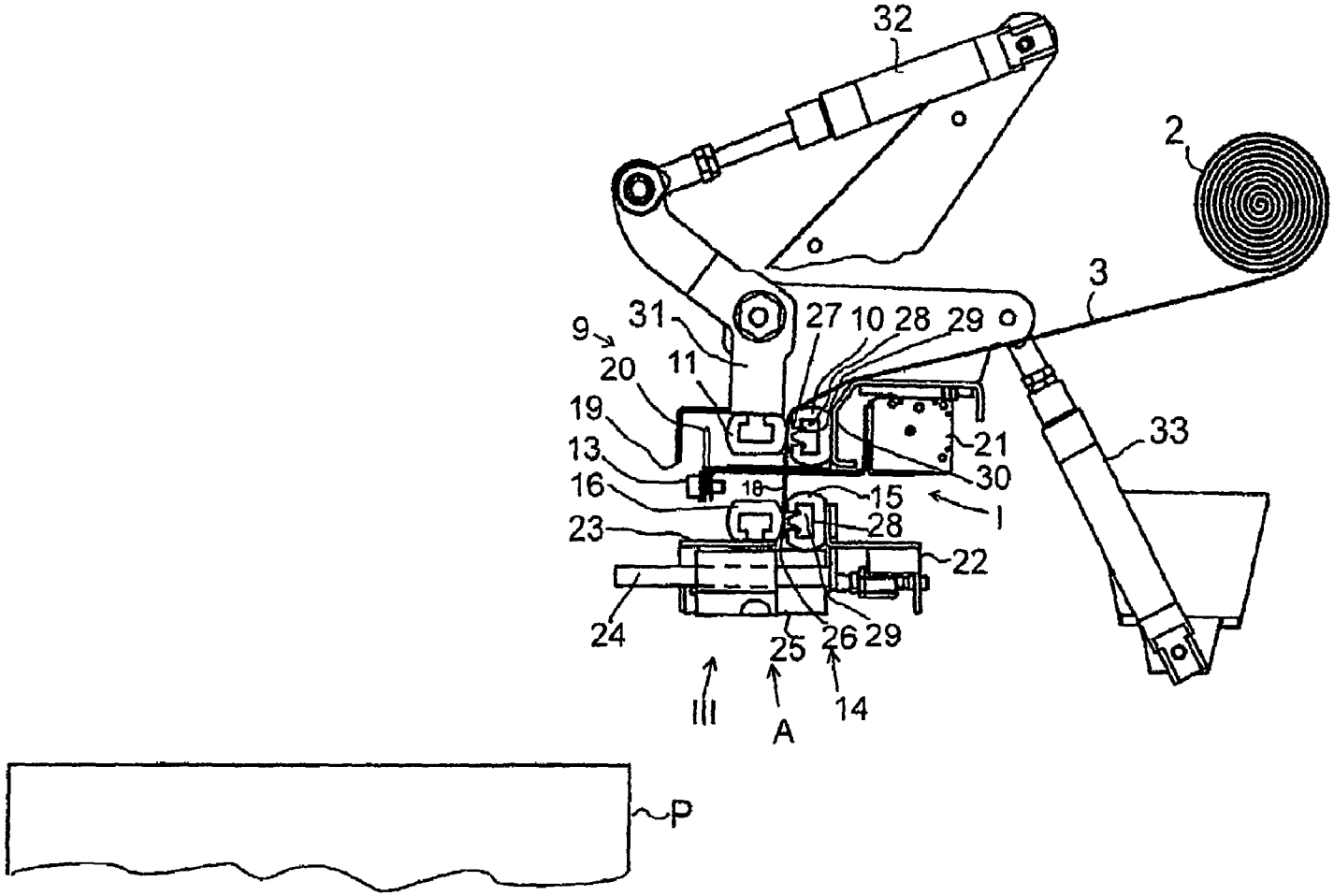

In FIG. 5, the holding device 9 is still in the position of FIG. 4, but the pulling jaws 15, 16 of the pulling device 14 engage the aforesaid downwards hanging length 18 of film web by a grip which is here referred to as a second grip, in other words, the pulling device 14 is in the closed position III.

Figure 6:
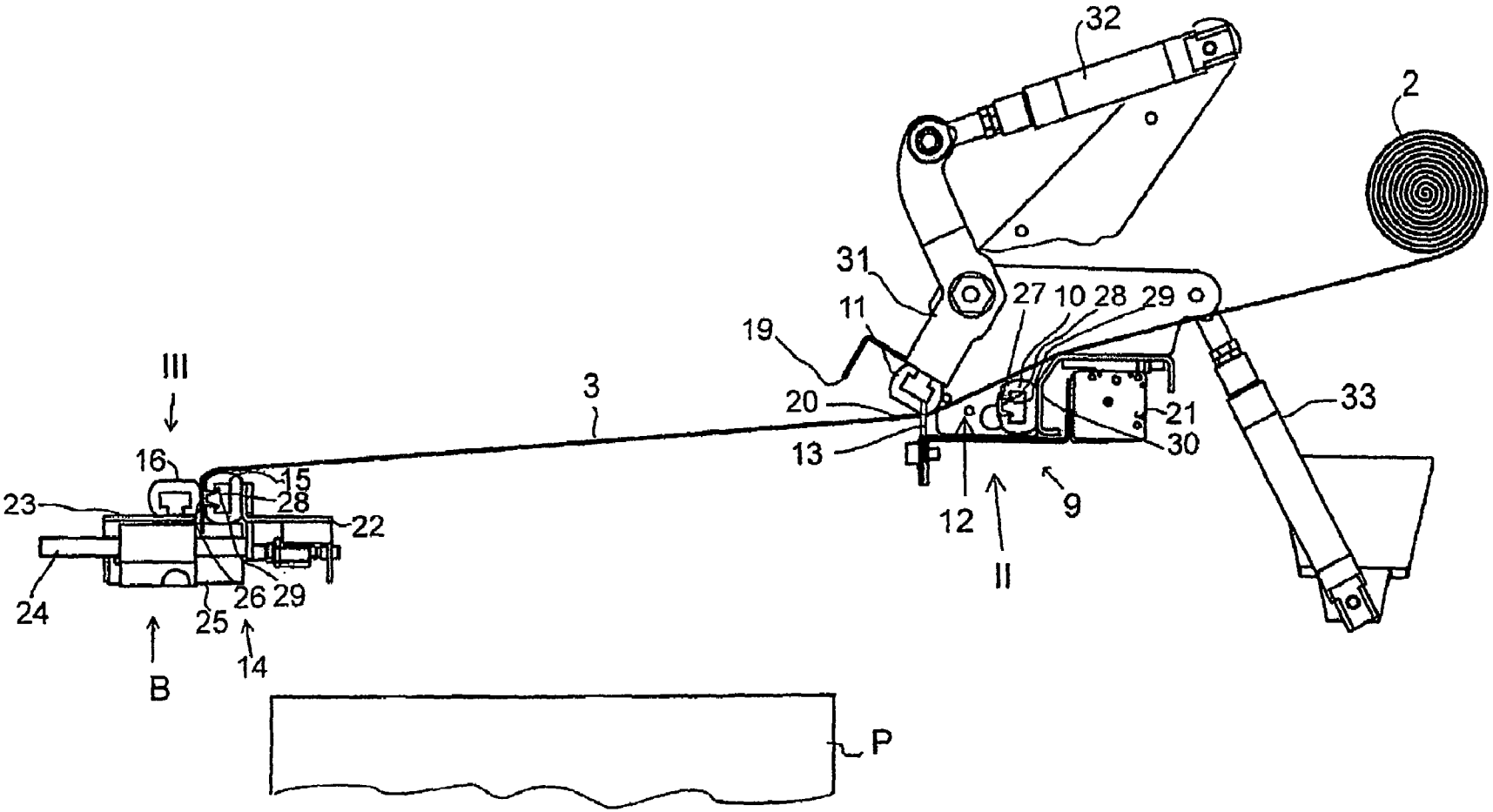

In FIG. 6, the holding jaws 10,11 of the holding device 9 are in the opened position II so that they have a first gap 12 between them, the aforesaid first grip being thus released, whereby the film web 3 can run between the holding jaws 10,11. The pulling jaws 15,16 of the pulling device 14 continue to hold the end of the film web 3 when the pulling device 14 has been moved, over the object P to be packaged, to the second position B, in which it is at a distance from the holding line of the holding device 9 and the cutting line of the cutting device 13 that substantially corresponds to the length of the top film sheet to be formed.

Figure 7:
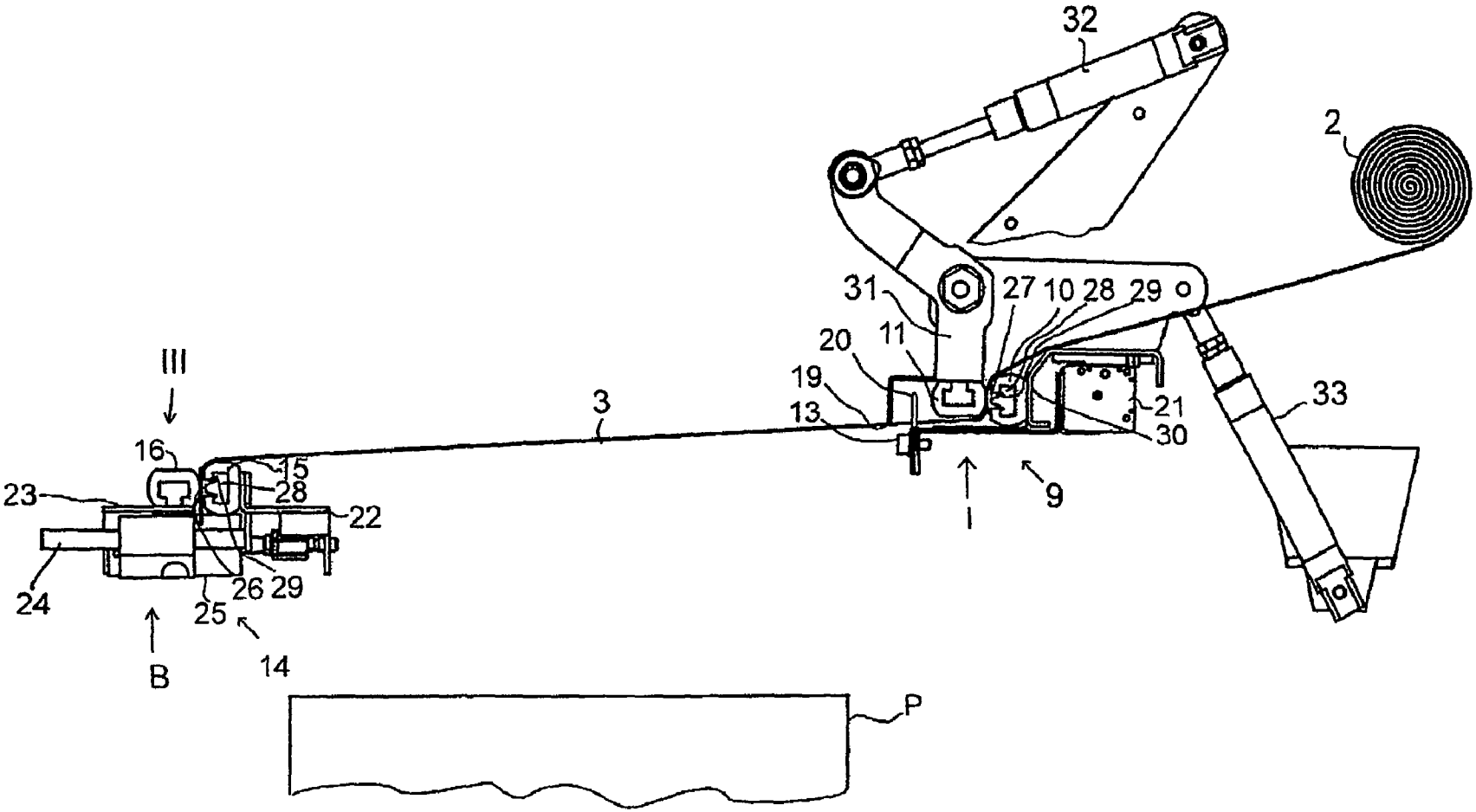

In FIG. 7, the pulling device 14 is still in the same position as in FIG. 6. The holding device 9 again engages the film web 3 by a grip which is here referred to as a third grip. The support 19 supports the film web in the area near the cutting device 13 from the top side of the film web over the entire width of the film web.

Figure 8:
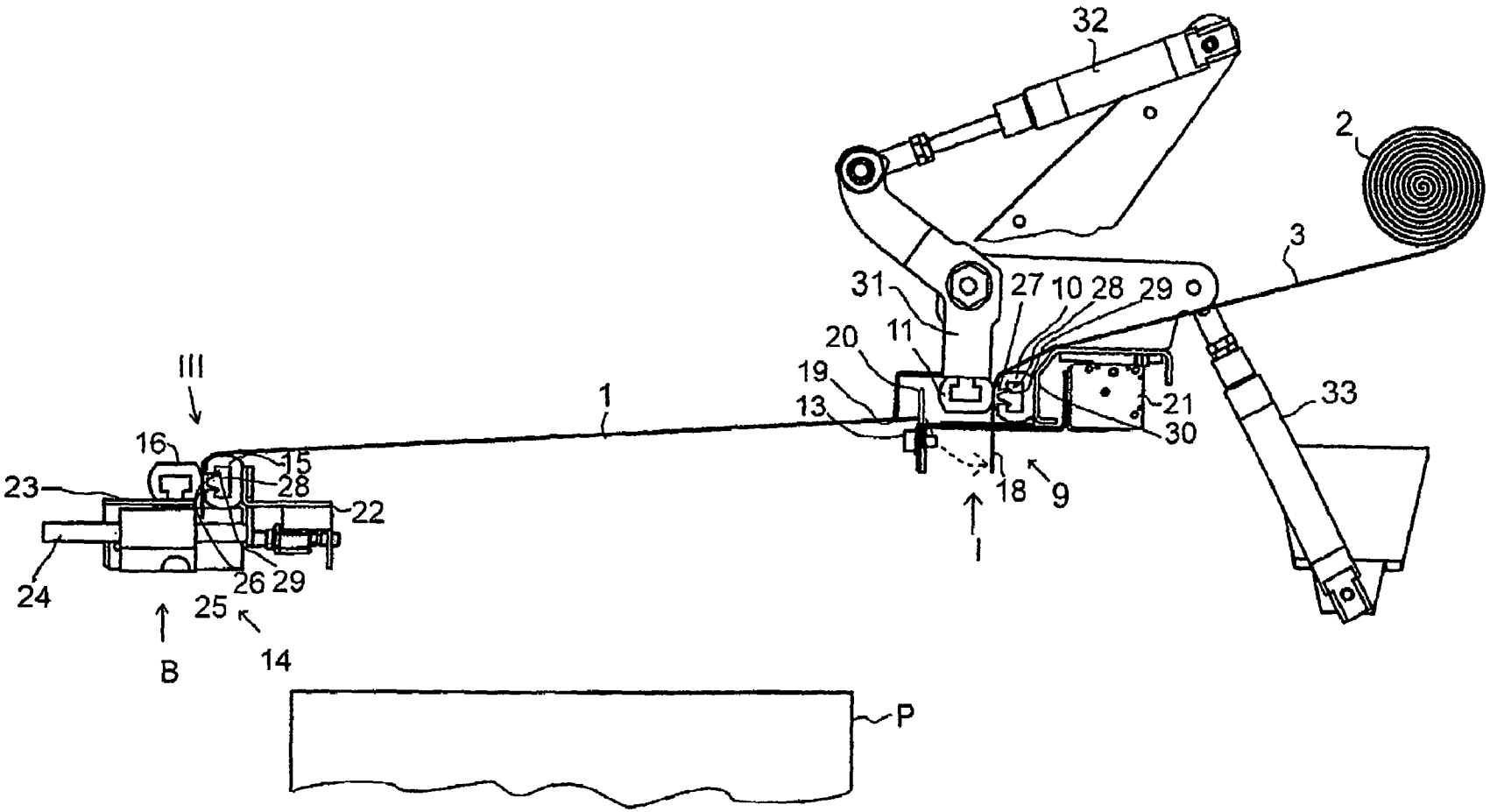
Figure 9:
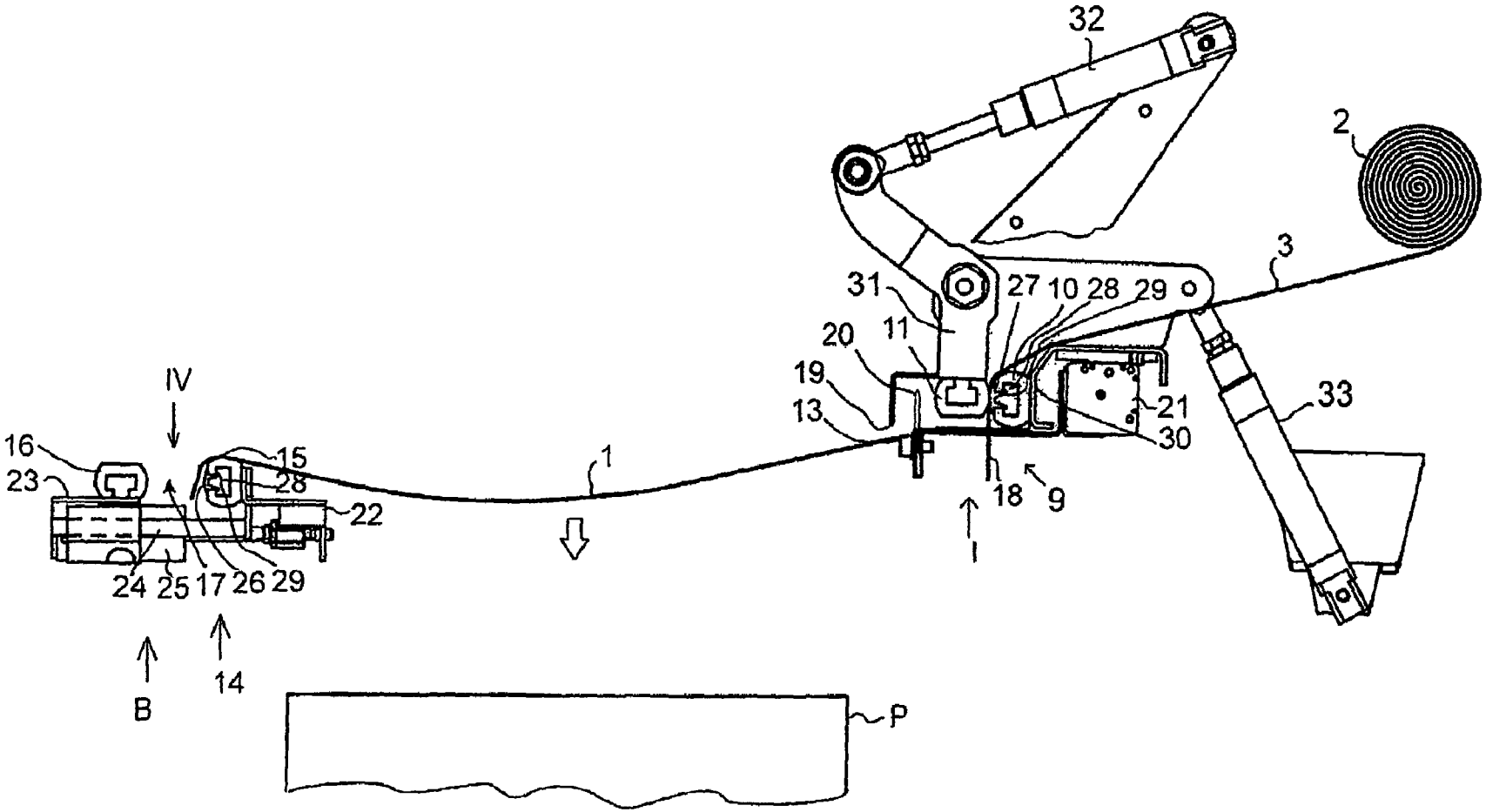
Figure 10:
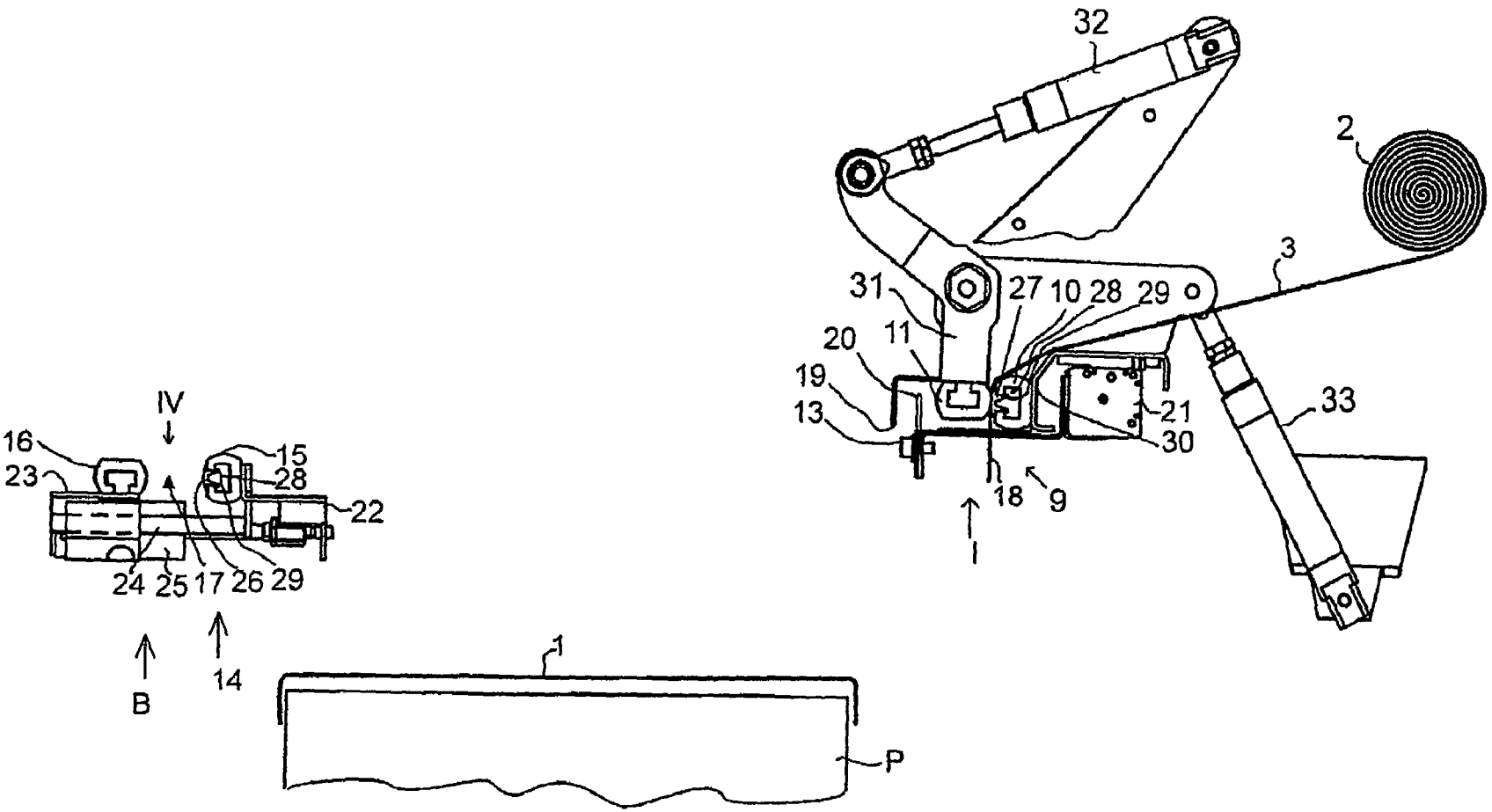

In FIG. 8, the slitting blade 10 of the cutting device 13 has slit the film web 3 apart, leaving on the side of the roll 2 a length 18 of film web hanging below the holding jaws 10, 11 so that it can be gripped by the pulling device 14, i.e. engaged again by a first grip to form the next top film sheet 1. A top film sheet 1 has now been formed. Immediately after the cutting, the pulling jaws 15, 16 of the pulling device 14 are opened into the opened position IV, in other words, the second grip is released, thereby releasing the top film sheet 1 so that it will fall down onto the object to be packaged below, as illustrated in FIG. 10.

Figure 11:
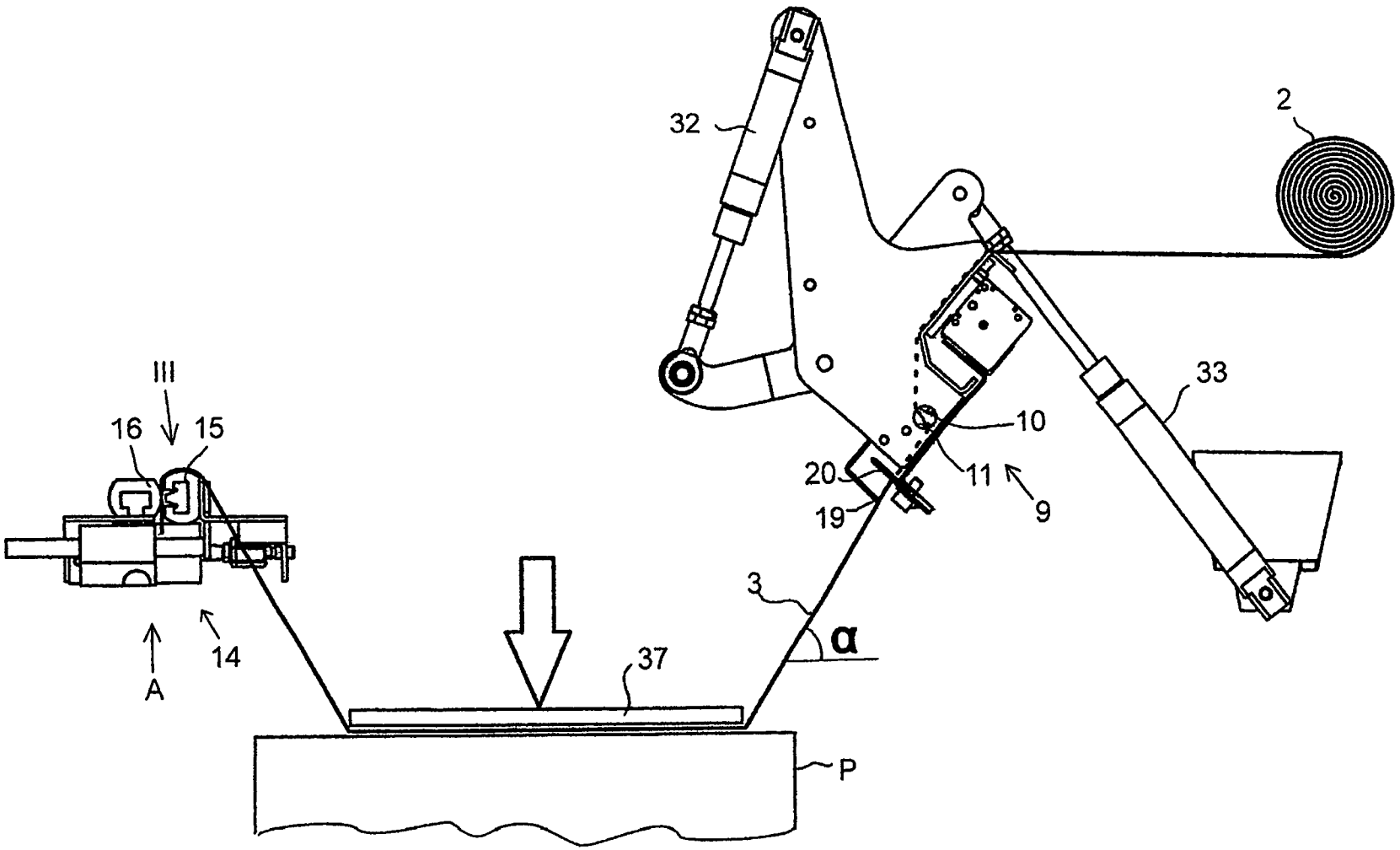

FIG. 11 additionally presents an alternative for the stage shown in FIG. 7 when a presser 37 is used to press the film web 3 against the upper surface of the object to be packaged. The presser 37 is used to ensure that the top film sheet will be set in a controlled manner on the object P. The presser 37 can be used e.g. when the upper surface of the object P to be packaged is at a very low level. In that case, the film web is at an angle $\alpha$ relative to the horizontal direction. In this situation, to bring the holding device 9, support 19, cutting blade 20 and film web 3 to an advantageous position where the web will be reliably severed, in respect of the direction of the film web, the entire holding device 9 is tilted by the fourth power means 33.

The invention is not limited to the embodiment examples described above; instead, many variations are possible within the scope of the inventive concept defined in the claims.

The invention claimed is:

1. Apparatus for forming a top film sheet from a film web wound upon a roll of film, and for depositing the top film sheet onto an object located at a packaging station so as to be packaged, comprising:

a framework;

a roll of film rotatably mounted upon said framework so as to permit film, having a predetermined transversely oriented width dimension and disposed upon said roll of film, to be unwound from said roll of film;

transversely oriented holding devices, mounted upon said framework so as to be movable with respect to each other between OPEN and CLOSED positions, and extending substantially along the entire width dimension of said film, for releasably holding a portion of said film with a holding force that is substantially uniformly applied along said entire width dimension of said film;

a cutting device disposed a predetermined distance from said holding devices for severing said film, at a location which is spaced from said holding devices, and upon completion of a top film sheet forming cycle, forms a free end portion of said film which depends downwardly from said holding devices; and transversely oriented pulling devices, movable with respect to each other between OPEN and CLOSED positions, extending substantially along the entire width dimension of said film for releasably gripping said downwardly dependent free portion of said film with a gripping force which is substantially uniformly applied along said entire width dimension of said film, and movably mounted upon said framework between an EXTENDED position at which said pulling devices are disposed beneath said holding devices so as to grip said downwardly dependent free end portion of said film, and a RETRACTED position at which said pulling devices are disposed remote from said holding devices so as to unwind a portion of said film from said roll of film and thereby form the top film sheet for deposition onto the object which is located at the packaging station so as to be packaged.

2. The apparatus as set forth in claim 1, wherein:

said holding devices comprise a pair of holding jaws wherein at least one of said pair of holding jaws is movable with respect to the other one of said pair of holding jaws between said CLOSED position, at which said pair of holding jaws fixedly hold said portion of said film therebetween, and said OPEN position at which said film can move freely between said pair of holding jaws.

3. The apparatus as set forth in claim 2, further comprising:

means for moving said at least one of said pair of holding jaws in a pivotal manner with respect to said other one of said pair of holding jaws between said CLOSED and OPEN positions.

4. The apparatus as set forth in claim 1, wherein:

said pulling devices comprise a pair of pulling jaws wherein at least one of said pair of pulling jaws is movable with respect to the other one of said pair of pulling jaws between said CLOSED position, at which said pair of pulling jaws fixedly grip said free end portion of said film therebetween, and said OPEN position at which said free end portion of said film is released from said pair of pulling jaws.

5. The apparatus as set forth in claim 4, further comprising:

means for moving said at least one of said pair of pulling jaws in a reciprocal manner with respect to said other one of said pair of pulling jaws between said CLOSED and OPEN positions.

6. The apparatus as set forth in claim 4, wherein:

said framework comprises a pair of transversely spaced guide beams; and said pair of pulling jaws are movably mounted upon said transversely spaced guide beams.

7. The apparatus as set forth in claim 6, further comprising:

first means for movably mounting said pair of pulling jaws in a reciprocal manner along said pair of transversely spaced guide beams between said EXTENDED and RETRACTED positions; and second means for moving said at least one of said pair of pulling jaws with respect to said other one of said pair of pulling jaws between said CLOSED and OPEN positions.

8. The apparatus as set forth in claim 1, wherein:

said cutting device comprises a slitting blade.

9. The apparatus as set forth in claim 8, wherein:

said slitting blade extends transversely with respect to said film so as to extend substantially the entire width dimension of said film.

10. The apparatus as set forth in claim 9, further comprising:

means for moving said slitting blade substantially perpendicular to said film so as to achieve cutting of said film and the formation of said top film sheet for deposition onto the object which is located at the packaging station so as to be packaged.

11. The apparatus as set forth in claim 1, further comprising:

presser means for engaging said top film sheet and for depositing said top film sheet onto the object which is located at the packaging station so as to be packaged.

* * * * *